US007571718B2

(12) United States Patent
Hendrix et al.

(10) Patent No.: US 7,571,718 B2
(45) Date of Patent: Aug. 11, 2009

(54) DEVICE FOR EXCHANGING HEAT

(75) Inventors: Daniel Hendrix, Stuttgart (DE); Florian Moldovan, Stuttgart (DE)

(73) Assignee: BEHR GmbH & Co. KG, Stuttgart (DE)

( * ) Notice: Subject to any disclaimer, the term of this patent is extended or adjusted under 35 U.S.C. 154(b) by 22 days.

(21) Appl. No.: 10/542,410

(22) PCT Filed: Nov. 7, 2003

(86) PCT No.: PCT/EP03/12468

§ 371 (c)(1),
(2), (4) Date: Jul. 15, 2005

(87) PCT Pub. No.: WO2004/065874

PCT Pub. Date: Aug. 5, 2004

(65) Prior Publication Data

US 2006/0048759 A1 Mar. 9, 2006

(30) Foreign Application Priority Data

Jan. 23, 2003 (DE) ..... 103 02 708

(51) Int. Cl.

| | |
|---|---|
| ***F02B 33/00*** | (2006.01) |
| ***F02B 29/04*** | (2006.01) |
| ***F28F 1/42*** | (2006.01) |
| ***F28F 3/00*** | (2006.01) |
| ***F28D 7/02*** | (2006.01) |

(52) U.S. Cl. ..... 123/563; 165/166; 165/179; 165/165

(58) Field of Classification Search ..... 123/563; 165/165, 166, 159, 179; 60/599
See application file for complete search history.

(56) References Cited

U.S. PATENT DOCUMENTS

| | | | | |
|---|---|---|---|---|
| 213,635 | A * | 3/1879 | Drache | 165/166 |
| 2,184,759 | A * | 12/1939 | Shipman | 165/166 |
| 2,803,440 | A * | 8/1957 | Simpelaar | 165/179 |
| 3,165,152 | A * | 1/1965 | Jones | 165/166 |
| 3,173,481 | A | 3/1965 | Barkley | 165/160 |
| 3,311,166 | A * | 3/1967 | Southam | 165/166 |
| 3,397,684 | A * | 8/1968 | Scherenberg | 123/563 |
| 3,508,606 | A | 4/1970 | Blanchard et al. | 165/145 |

(Continued)

FOREIGN PATENT DOCUMENTS

DE 3439444 A1 * 4/1986

(Continued)

*Primary Examiner*—Thai-Ba Trieu
(74) *Attorney, Agent, or Firm*—Foley & Lardner LLP

(57) ABSTRACT

Disclosed is a device for exchanging heat, especially for cooling the combustion air of internal combustion engines in motor vehicles, which is characterized by the fact that the flow devices (14) are accommodated in an profiled housing (6) comprising at least two parts. The cross section of a first housing part (6*a*) is essentially U-shaped, said basic shape being closed at the open end of the first housing part (6*a*) by means of a second, substantially planar housing part (6*b*). The inventive device is further characterized by the fact that the housing (6) comprises at least one inlet flange and at least one outlet flange for the second medium at two opposite sides while the flow devices (14) are kept at a distance from each other in at least one area by means of at least one frame device (12) which is accommodated within the housing (6).

33 Claims, 6 Drawing Sheets

U.S. PATENT DOCUMENTS

| | | | | | |
|---|---|---|---|---|---|
| 3,907,032 | A | * | 9/1975 | DeGroote et al. | 165/166 |
| 4,298,059 | A | * | 11/1981 | Krauth et al. | 165/166 |
| 4,436,145 | A | | 3/1984 | Manfredo et al. | 123/563 |
| 4,653,574 | A | * | 3/1987 | Quinlisk et al. | 165/231 |
| 5,031,693 | A | * | 7/1991 | VanDyke | 165/166 |
| 5,400,854 | A | * | 3/1995 | Iio et al. | 165/166 |
| 5,682,945 | A | * | 11/1997 | Lehman | 165/166 |
| 6,247,523 | B1 | * | 6/2001 | Shibagaki et al. | 165/166 |
| 6,983,788 | B2 | * | 1/2006 | Haglid | 165/166 |
| 7,195,060 | B2 | * | 3/2007 | Martin et al. | 165/166 |
| 7,237,604 | B2 | * | 7/2007 | Emrich et al. | 165/167 |
| 2003/0010479 | A1 | | 1/2003 | Hayashi et al. | 165/159 |

FOREIGN PATENT DOCUMENTS

| | | | | |
|---|---|---|---|---|
| DE | 199 27 607 | A1 | | 12/2000 |
| EP | 38454 | A2 | * | 10/1981 |
| EP | 578916 | A2 | * | 1/1994 |
| GB | 2132748 | A | * | 7/1984 |
| JP | 5-141892 | A | | 6/1993 |
| JP | 2001-241883 | A | | 9/2001 |
| JP | 2002-332920 | A | | 11/2002 |

* cited by examiner

DEVICE FOR EXCHANGING HEAT

BACKGROUND OF THE INVENTION

The invention relates to a device for exchanging heat, in particular for cooling the combustion air of internal combustion engines in motor vehicles. Such devices for exchanging heat, which are also referred to as charge air coolers, are used to cool the combustion air of an internal combustion engine. However, the invention can also be applied to other heat exchangers.

In this context, combustion air, which has a high temperature level due to compression, is directed through the device and cooled down using a refrigerating agent, which also flows through the device. DE 199 27 607 discloses devices in which the combustion air is directed through the device through a plurality of pipes in order to exchange heat and which have a feed means and a discharge means for a refrigerating agent, as a result of which this refrigerating agent flows around the pipes. In order to ensure that between the pipes there are distances through which the refrigerating agent can flow, in the prior art the ends of the pipes are widened so that the pipes are each respectively spaced apart from one another.

However, this method of manufacture has the disadvantage that the individual pipes have to be aligned very precisely with one another and the soldering together of the device is technically very complex. In addition, it is known to construct the housing of such devices from two components, for example in such a way that it has a U-shaped base body as well as a cover which is inserted into this base body. However, this procedure has the disadvantage that the cover can move in relation to the base, which adversely effects the fabrication precision.

SUMMARY OF THE INVENTION

The object of the present invention is therefore to make available an improved device which has the purpose of exchanging heat and which can, in particular, be manufactured cost-effectively.

The subject matter of the present invention is a device for exchanging heat, in particular for cooling the combustion air of internal combustion engines in motor vehicles, which device has at least one feed means and one discharge means of a first medium, such as, for example, a refrigerating agent, coolant or some other medium, and at least one feed means and one discharge means of a second medium such as, for example, combustion air, exhaust gas or some other medium. In addition, at least one flow device is provided for the refrigerating agent and at least one flow device is provided for the combustion air, wherein the flow paths of the flow devices of a refrigerating agent and of the combustion air are separated from one another and the flow directions are at least partially different.

A flow device is understood here to be a device which spatially separates the flowing medium, for example, pipes, in particular flat pipes and the like. The device can have a plurality of components.

The term flow device is also understood to refer to the intermediate space between two bodies, which intermediate space forms a flow path if a medium can flow in it. For example, the region between two flat pipes is to be considered to be a flow device.

A refrigerating agent is to be understood generally as any gaseous or liquid medium which has a lower temperature than the medium to be cooled, i.e. the combustion air. Refrigerating agents include, in particular, water, possibly with additives such as glycol, in particular from the cooling circuit, so that water is also used below in place of refrigerating agent.

The flow path of a medium is to be understood as the path within a flow device which the refrigerating agent travels along, for example, between the feed means and the discharge means within the device for cooling combustion air.

The flow direction is the direction of flow which the medium, that is to say the refrigerating agent or the combustion air, takes within the flow devices for cooling combustion air, at least over a specific time period.

The invention is also characterized in that the flow devices are accommodated in an at least two-component, contoured housing, wherein a first housing component has an essentially U-shaped outline cross section which is closed by a second, essentially planar housing component at the open side of the first housing component.

The housing of the device also has at least one inlet flange and at least one outlet flange for the combustion air on two opposite sides.

The flow devices for the combustion air and/or the refrigerating agent are held spaced apart from one another in at least one region by means of at least one frame device which is accommodated in the housing.

A two-component housing is to be understood as meaning that the housing is not manufactured from one basic body but rather has two separate components which are combined, and in particular connected, to one another.

Contoured is to be understood as meaning that the edges at which the component of the housing are joined to one another do not extend linearly but rather deviate from this in a specific way. For example, in one component of the housing it is possible to provide notches or grooves in which projections of the second component of the housing engage. In addition, it is also possible to provide projections which have any desired geometrical shape and which engage in corresponding recesses of the corresponding, other component of the housing.

In the present invention, a U-shaped outline is to be understood as meaning shapes whose cross section is described essentially by a rectangle in which one of the four sides is missing. However, in such a case the individual corners may also be rounded or one side may be made circular or ellipsoidal. The profile of the individual side does not necessarily have to be linear either.

The term "U-shape" in the present invention also describes configuration shapes in which a longer side of the rectangle is in the cross section of the omitted side.

Finally, shapes which have essentially an ellipsoidal cross section are also included, in which case a segment is cut out of this ellipse.

A flat component of the housing is understood to be a component of the housing which extends essentially in two dimensions, that is to say forms essentially one plane.

A frame device in the sense of the present invention is understood to be any device which is suitable for keeping flow devices at a predefined distance from one another.

In one preferred embodiment, at least one component of the two-component housing has the feed means and the discharge means for the refrigerating agent.

The feed means and discharge means for the refrigerating agent are preferably arranged on the same side of the housing. Alternatively, the feed means and the discharge means for the refrigerating agent may be arranged on different, in particular opposite, sides of the housing. The feed means and discharge means may be arranged at the same height or at different heights on the housing. A duel inflow and/or outflow may also be provided.

In one embodiment, the feed means and the discharge means for the refrigerating agent are arranged in the vicinity of two corners of the device, in which case the connection of these corners is the spatial diagonal of the device.

The flow devices of the combustion air are preferably flat pipes. A flat pipe is understood here to be a pipe which has a specific width and a low height in comparison with this width. These flat pipes may have a rectangular, ellipsoidal or similar cross section. Flat pipes of the flow device of the combustion air are preferably essentially arranged parallel to one another.

The flow device of the refrigerating agent preferably has turbulence devices such as, for example, turbulence grills or plates, patterned surfaces, turbulence generators etc.

The term patterned surfaces is to be understood here as meaning that the surfaces are not smooth but rather have projections, channels, lugs or similar devices which increase the turbulence of the medium flowing past them and thus improve the transfer of heat between the wall and the medium.

The flow device of the refrigerating agent preferably has dividing elements which define at least one predetermined flow path for the refrigerating agent. However, this is not to be understood in particular as meaning exclusively that the refrigerating agent cannot pass from the inlet to the outlet over the shortest path but rather that these separating means cause the refrigerating agent to flow through essentially the entire region of the housing. What is referred to as positive guidance may also be understood by this.

The components of the devices such as, for example, the flow devices, the housing, the feed means and discharge means for the refrigerating agent, the inlet flange and outlet flange for the combustion air etc. are preferably manufactured from at least one material which is selected from a group of materials which contains metals such as aluminum, iron, brass, copper, titanium etc., metal alloys such as aluminum alloys, iron alloy etc., plastics such as PVC, PU, duroplastics, fiber-reinforced plastics etc.

In the preferred embodiment, the first housing component forms essentially three contoured side faces of a cube, wherein the orientation of the contouring assumes a predefined angle with respect to a main direction of flow of the combustion air.

A contoured side face is in turn to be understood as meaning that the side face is not a smooth face but rather has predefined deviations from a smooth surface.

The second housing component preferably has an external contour which is adapted to the profile contour of the first housing component. This ensures that the second component of the housing can be fitted precisely into a face which is predefined by the contouring elements of the first component of the housing.

In one preferred embodiment, the inlet flange and outlet flange are constructed from at least two components and they close off the housing at two opposite end sides of the cube in a gas-tight and/or liquid-tight fashion. The inlet flange and/or the outlet flange preferably have a deep-drawn base body with a bushing which accommodates a predefined distance of a pipe, in particular of a connecting pipe, or fits into it. For this purpose, the inlet or outlet flange can also have an elevated portion such as a bead, which improves the connection to a further pipe.

Preferably, the feed means and the discharge means for the refrigerating agent are provided as bushings in the housing which accommodate the predefined section of a pipe, in particular of a connecting pipe, or fit into it. Here too, elevated portions or beads which facilitate connection to a connecting pipe may also be provided on the feed means.

The second housing component, the boundary element and the flanges preferably form a gas-tight and/or liquid-tight termination of the end sides of the housing.

In a further preferred embodiment, at least two frame devices are provided which keep at least the flat pipes of the flow device of the combustion air spaced apart. Here, the frame devices are preferably arranged in the vicinity of the ends of the flat pipes. However, other arrangements of the frame devices are also conceivable. In particular it is conceivable for a frame device to function simultaneously as a dividing element in order to permit the refrigerating agent to be distributed essentially over the entire interior of the refrigerating agent flow device.

The frame device is preferably an essentially planar plate which has a predefined number of bushings for accommodating the flat pipes. These bushings have a cross section which corresponds essentially to the cross section of the flat pipes or is slightly larger than said cross section.

In one particularly preferred embodiment, the frame device and the flat pipes are connected to one another in a gas-tight and/or liquid-tight fashion.

In addition, a materially joined, frictionally locking and/or positively locking connection is preferably provided between the components of the device. In one preferred embodiment the components of the device for exchanging heat may be connected by means of a soldered connection in this context.

In a further preferred embodiment, the frame device is a plate with upturned edges which are connected, in particular, to at least one section of the internal contour of the housing. However, instead of the upturned edges, the frame device can also have a drawn, edged or rounded edge.

The present invention is also directed at internal combustion engines having an exhaust gas turbocharger or compressor which have at least one device for exchanging heat according to the present invention.

The present invention is also directed at a method for exchanging heat, in particular for cooling combustion air, in particular for charge air of internal combustion engines, wherein, in a first method step, combustion air is introduced at a temperature T1 in a first flow path, of the device according to the invention, wherein, in a second method step, a refrigerating agent with a temperature T2 is directed into a second flow path of the same device, it is heat transferred between the combustion air and the refrigerating agent in a further step, and wherein finally the combustion air is carried away at a temperature T3, wherein the temperature T1 is higher than the temperature T3, and the temperature T3 is higher than the temperature T2.

BRIEF DESCRIPTION OF THE DRAWINGS

Further advantages and refinements of the present invention emerge from the appended figures, of which.

DETAILED DESCRIPTION OF THE INVENTION

Figure 1:
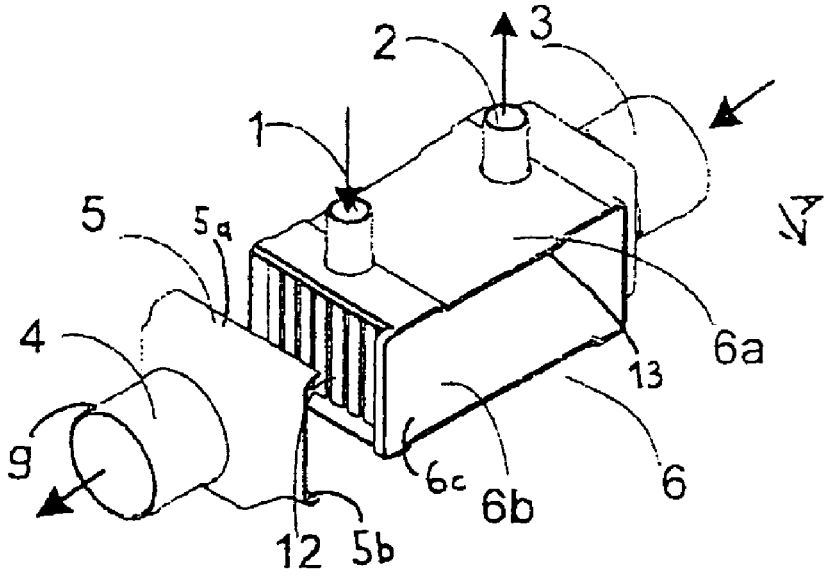
FIG. 1 shows a heat exchanger according to the invention according to a first embodiment.

FIG. 1 shows a heat exchanger according to the invention in a partially exploded view. The reference numbers 1 and 2 relate to a feed means and a discharge means for a refrigerating agent, respectively.

This refrigerating agent is preferably water, in particular water with additives, for example glycol, from the cooling circuit. However it is also possible to provide other refrigerating agents, either in a gaseous or liquid phase.

The reference numbers 3 and 4 relate to a feed means and a discharge means for the combustion air, that is to say for the air to be cooled. The feed means and discharge means are embodied in the form of inlet and outlet flanges which can each be connected to a further feed line. These connections can either be formed by pipes with relatively large circumferences being fitted over the flanges or pipes with relatively small circumferences being inserted into the openings. A bead 9 which permits a more stable connection between the feed line pipe and the flange can preferably be provided on the respective flanges.

The reference number 12 designates a frame device whose function will be described in more detail below. The reference number 6 relates to a housing for the device for exchanging heat. The feed means and discharge means for the refrigerating agent and the feed means and discharge means for the combustion gas as well as the cover device 5 and the cover device lying opposite are not components of this housing.

In this embodiment the housing is composed of a first component 6*a* which is essentially in the shape of a U. In FIG. 1, the open side of this U is pointing in the direction of the arrow A. In addition, the housing has a second component 6*b* which is embodied here as a cover which covers that side of the U-shaped, first component which is open at the top.

The U-shaped, first component has contouring elements 13 into which the second component with corresponding contouring elements is fitted.

In FIG. 1, the second housing component 6*b* is embodied essentially in the form of a rectangle which has counter sunk sections on its longer sides.

Figure 2:
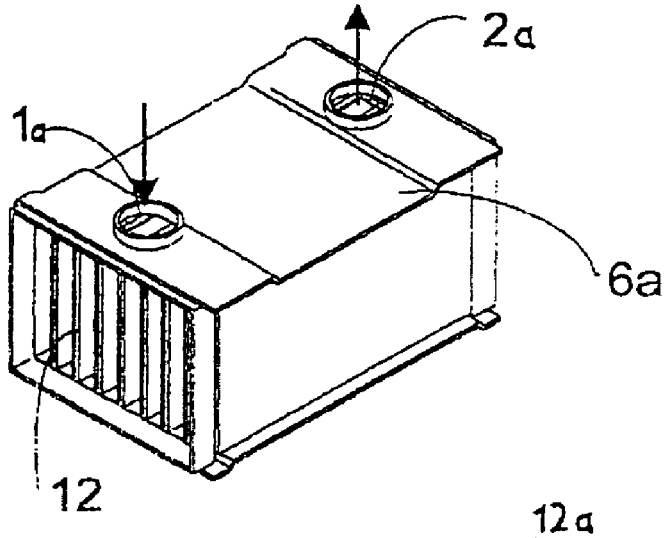
FIG. 2 shows a detailed view of the heat exchanger according to the invention from FIG. 1.

FIG. 2 shows a detailed view of the device for exchanging heat which is shown in FIG. 1. Reference numbers 1*a* and 2*a* relate to flanges in which the feed means and the discharge means for the refrigerating agent 1 and 2 can be inserted. The reference number 6*a* relates in turn to the first U-shaped component of the housing which has a profile structure. The second component, that is to say the cover of the housing, has however been omitted from this drawing. The reference number 12 indicates the frame device again.

Figure 3:
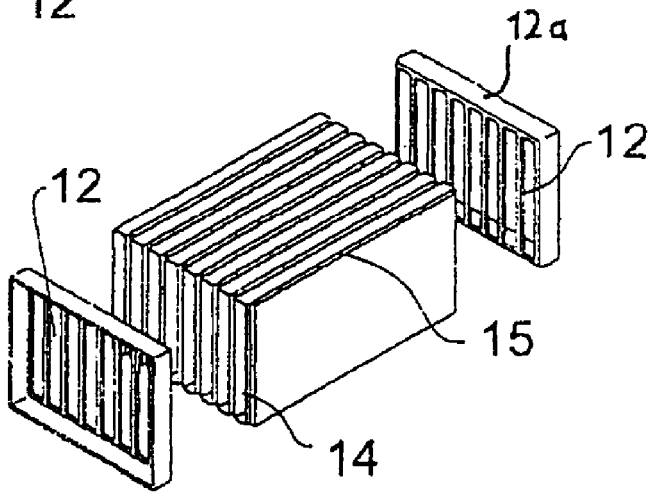
FIG. 3 shows a detailed view of the heat exchanger from FIGS. 1 and 2.

FIG. 3 shows, as a further detailed view, the interior of the housing 6 of the device for exchanging heat from FIG. 1. Flat pipes 14 through which the combustion air flows are arranged inside the housing 6. Contoured plates 15 are arranged between the individual flat pipes.

Contouring is understood to be countersunk portions, elevated portions, furrows and the like. The devices 15 are preferably also turbulence devices such as turbulence grills or plates, patterned surfaces, turbulence generators or the like.

The frame device 12 serves to keep the individual flat pipes 14 at a predetermined distance. The frame device 12 has an edge 12*a* so that a more stable connection can be brought about between the frame and the housing.

During operation, the refrigerating agent flows out of the cooling circuit into the device through the feed means 1. Here, the refrigerating agent is essentially distributed over the entire spatial content of the housing, with the contouring elements of the devices 15 improving the transfer of heat with the flat pipes. Finally, the refrigerating agent is discharged from the device again via the discharge means 2.

The cover 5 which bears the discharge means for the combustion gas has edges 5*a* and 5*b* only on three side edges, with the third side edge bearing against the side facing away from the viewer. On the fourth side, a proceeding component 6*c* of the housing component 6*b* is inserted into the cover 5.

Figure 4:
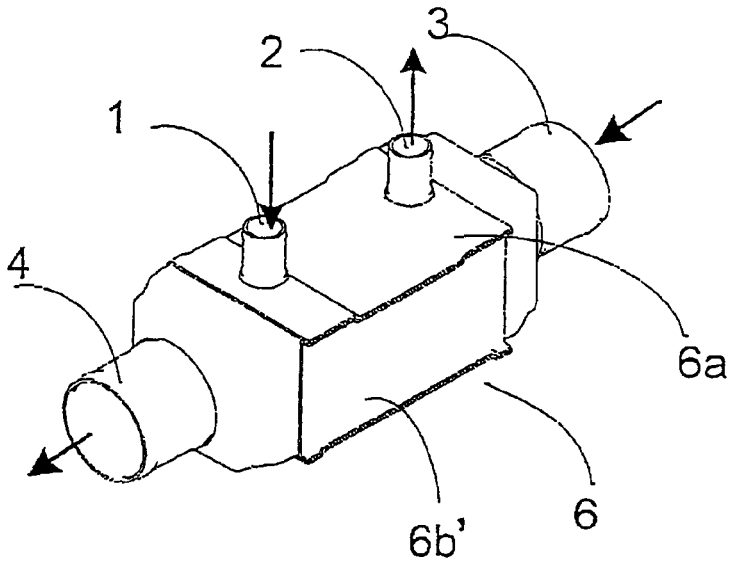
FIG. 4 shows a heat exchanger according to the invention according to a further embodiment in the assembled state.

FIG. 4 shows a device according to the invention for transferring heat in a further embodiment, in the assembled state. The reference numbers 1 and 2 relate in turn to a feed means and a discharge means for the refrigerating agent. The reference numbers 3 and 4 refer to feed means and discharge means for the combustion gas. The arrows each present the directions of flow of the combustion air and of the refrigerating agent. The housing has in turn a first U-shaped component 6*a,* and a second component in the form of a cover 6*b*'. In contrast to the embodiment shown in FIG. 1, the second component, that is to say the cover does not project beyond the U-shaped, first component in the lateral direction, i.e. a section 6*c* is not present here.

Figure 5:
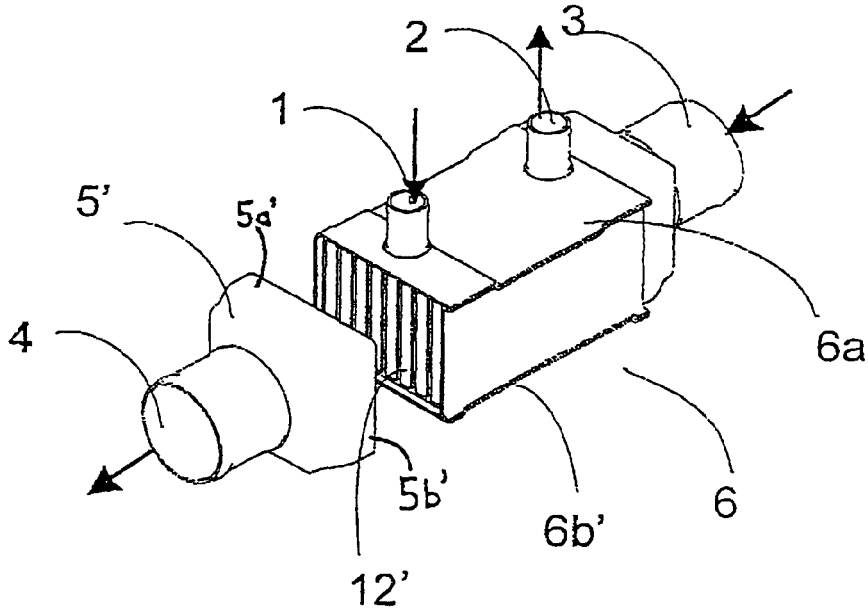
FIG. 5 shows a heat exchanger according to the invention from FIG. 4 in a partially exploded view.

FIG. 5 shows a partially exploded view of the device for exchanging heat which is shown in FIG. 4. It is apparent that the second component, that is to say the cover 6*b*', adjoins the first component 6*a* at the same height. In contrast to the cover of the combustion gas discharge means 5, the cover of the combustion gas discharge means 5' has four edges 5*a*', 5*b*', 5*c*', 5*d*' (5*c*' and 5*d*' not shown) which project laterally in the same way.

Figure 6:
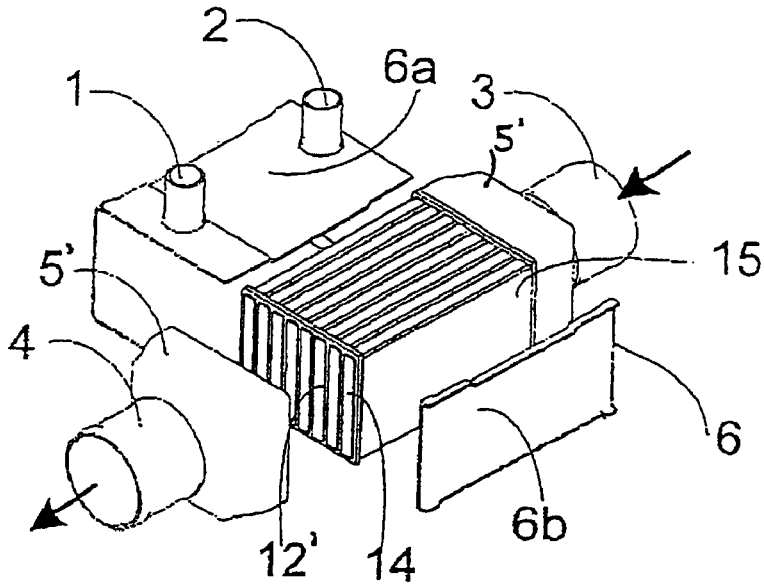
FIG. 6 shows the heat exchanger according to the invention from FIG. 4 in a further exploded view.

FIG. 6 shows an exploded view of the device shown in FIG. 4. It is apparent that the flat pipes 14 are pushed through the frame device 12'. The second component of the housing, that is to say the cover 6*b,* has in turn contoured elements which are adapted to the corresponding contoured elements of the first component of the housing 6*a.* When the device is assembled, the cover device 5' is pushed over the frame 12'. The cover for the combustion air feed means and the cover for the combustion air discharge means are preferably formed in the same way.

Figure 7:
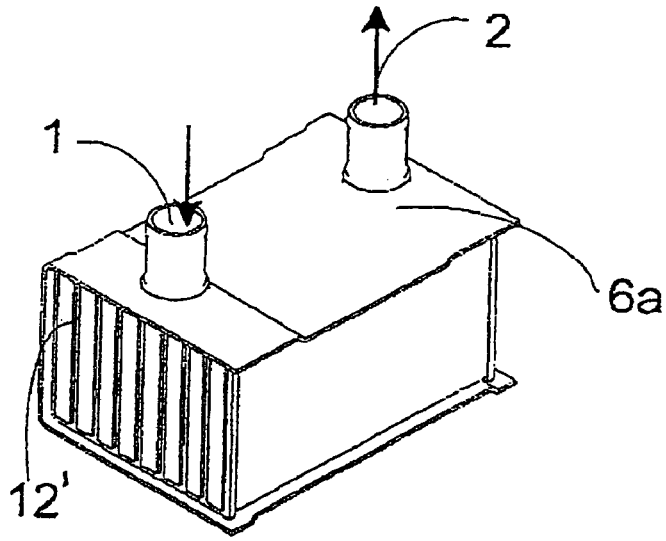
FIG. 7 shows a detailed view of the heat exchanger according to the invention from FIG. 4.

FIG. 7 shows a detailed view of the device from FIG. 6. The second housing component 6*b* has been omitted in order to permit a clear view of the interior of the housing.

Figure 8:
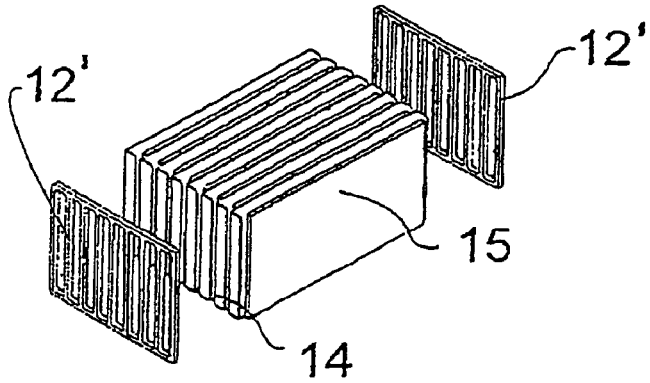
FIG. 8 shows a detailed view of the heat exchanger according to the invention from FIGS. 4 to 7.

FIG. 8 shows a further detail of the device for exchanging heat. The refrigerating agent flows in the same way here as in the case of the first embodiment and is therefore not described in more detail. In contrast to the frame device in the first embodiment, the frame device 12' is not provided with edges here but rather is of essentially two-dimensional design. In this exemplary embodiment, the devices 15, which are referred to below as turbulence generators, are also present again.

However, it is also possible, instead of these turbulence generators, to leave free spaces between the flat pipes between which the refrigerating agent can flow in an essentially unimpeded fashion. In the present embodiment, the device is designed on the basis of the counterflow principle, that is to say the feed means for the refrigerating agent lies on the same side as the discharge means for the combustion air and the discharge means for the refrigerating agent lies on the same side as the feed means for the combustion air. However, it is also possible to interchange the position of the feed means and discharge means for the refrigerating agent and feed means and discharge means for the combustion gas.

Length I of the device lies between 50 mm and 600 mm, in particular between 100 mm and 600 mm, preferably between 150 mm and 500 mm, and more preferably between 200 mm and 400 mm. The height h of the flat pipes is between 2 mm and 40 mm, in particular between 4 mm and 10 mm, preferably between 7.5 mm and 8.5 mm.

Figure 10:
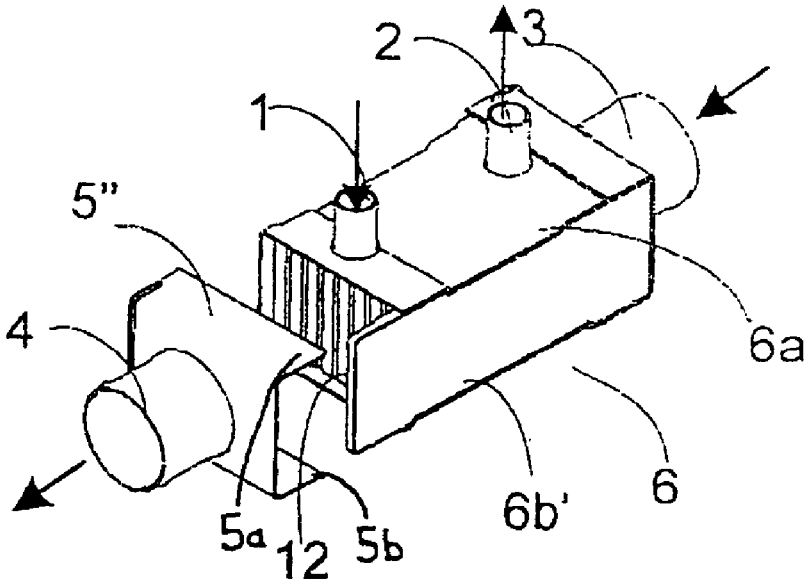
FIG. 10 shows the heat exchanger according to the invention as in FIG. 9 in a partially exploded view.

FIG. 10 illustrates a further embodiment of the device according to the invention for exchanging heat. The essential difference from the embodiment described above is the configuration of the second housing component 6*b*', that is to say of the cover, and in the configuration of the cover device 5". The cover device 5' is formed from a simple contour and therefore has only two side walls 5*a* and 5*b*. The second component of the housing 6*b*' is inserted into one of the intermediate spaces between the side walls 5*a* and 5*b*.

Figure 11:
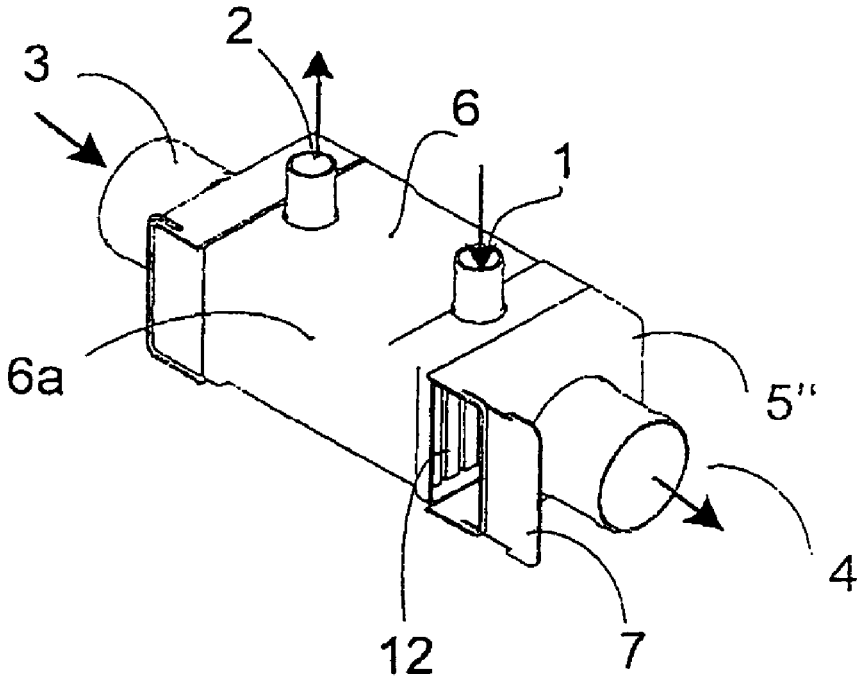
FIG. 11 shows an illustration of the heat exchanger from FIG. 10 from another perspective.

FIG. 11 shows a representation of the device from FIG. 10 from another perspective. Since the cover 5" has only two side walls and only one side wall is replaced by the second component of the housing 6*b*', a device is necessary to close the remaining opening. This is done by means of a panel 7 which is inserted into the last side wall. The corresponding cover for the feed means of the combustion gas 3 is of corresponding design. However it is to be noted that the two covers for the feed means and the discharge means of the combustion gas are preferably embodied in the same way, but this is not necessarily the case. For example, covers of different embodiments may be combined with one another.

Figure 9:
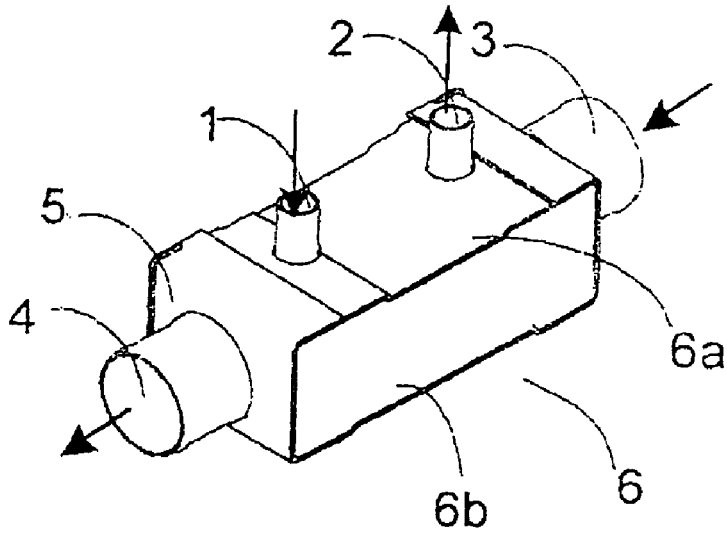
FIG. 9 shows a heat exchanger according to the invention according to a further embodiment in the assembled state.

FIG. 9 shows the device according to the invention for exchanging heat according to the third embodiment in the assembled state.

Figure 12:
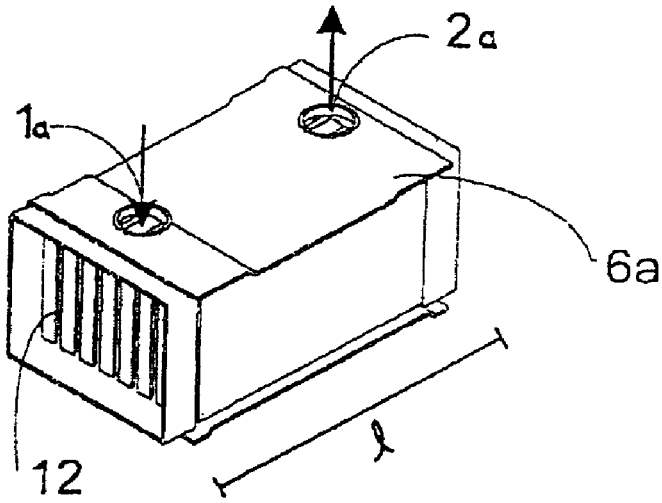
FIG. 12 shows a detailed view of the heat exchanger from FIG. 9.
Figure 13:
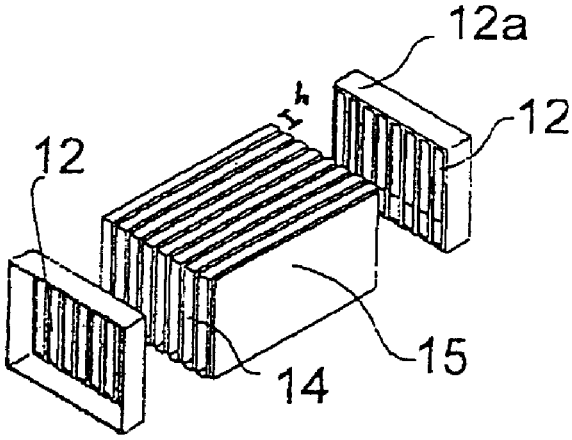
FIG. 13 shows a detailed view of the heat exchanger from FIGS. 9 to 12.

FIG. 12 is a detailed view of the device according to the invention for exchanging heat shown in the third embodiment. As is apparent from FIG. 12 and FIG. 13, the frame devices 12 and 12*a* are fitted onto the respective ends of the flat pipes 14.

Figure 14:
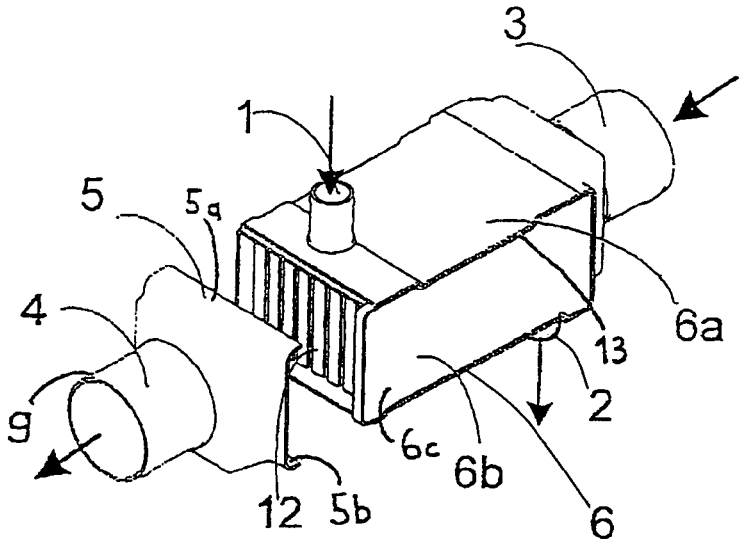
FIG. 14 shows a heat exchanger according to the invention according to a further embodiment.

FIG. 14 shows a heat exchanger in a partially exploded view according to a further embodiment of the invention. In this embodiment, the feed means and the discharge means for the first medium, such as the refrigerating agent, are arranged on different, in particular opposite, sides of the housing.

Figure 15:
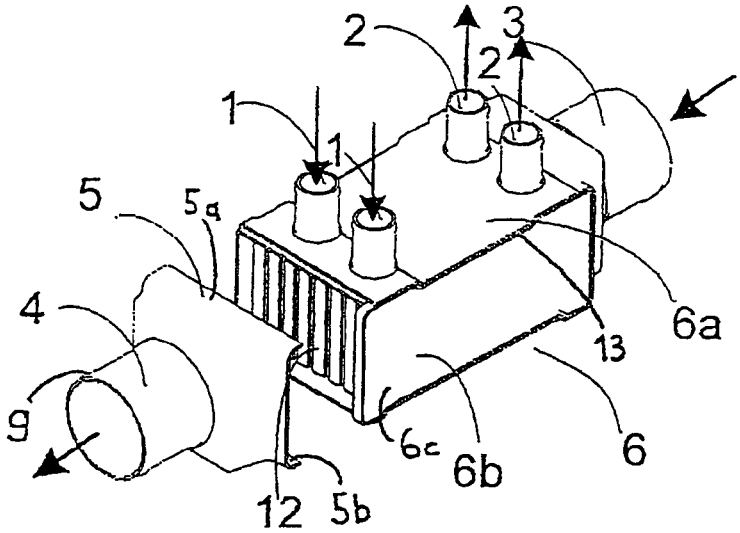
FIG. 15 shows a heat exchanger according to the invention according to a further embodiment.

FIG. 15 shows a heat exchanger in a partially exploded view according to another embodiment of the invention. In this embodiment, a double feed means and a double discharge means is provided for the first medium, such as the refrigerating agent. Of course, the feed means can be either a double or single feed means, and the discharge means can be a double or a single discharge means.

Figure 16:
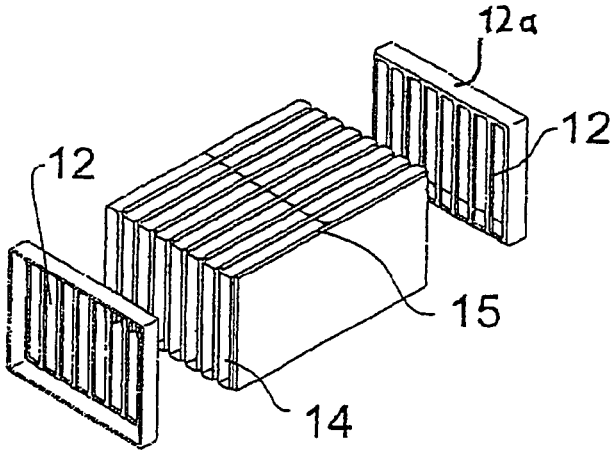
FIG. 16 shows a detailed view of the heat exchanger according to the invention according to a further embodiment.

FIG. 16 shows a detailed view of the heat exchanger according to yet another embodiment of the invention. In this embodiment, the flat pipes are arranged in parallel and in series with one another. Of course, one, two or more rows of parallel pipes can be used. Also, the rows of flat pipes are arranged parallel to one another and/or in series with one another.

The invention claimed is:

1. A device for exchanging heat in an internal combustion engine in a motor vehicle, comprising:

an at least two-component, contoured housing with first and second housing components, wherein the first housing component has an essentially U-shaped outline cross section which is closed by the second housing component at an open side of the first housing component, wherein the second housing component is essentially planar, wherein edges of the first and second housing components that join together do not extend linearly;

at least one first feed means for a first medium;

at least one first discharge means for the first medium;

at least one second feed means for a second medium on a first side of the housing;

at least one second discharge means for the second medium on a second side of the housing opposite the first side;

at least one first flow device for the first medium with a first flow path in a first flow direction, wherein the first flow device is accommodated in the housing;

at least one second flow device for the second medium with a second flow path in a second flow direction, wherein the second flow device is accommodated in the housing, wherein the first and second flow paths are separated from one another and the first and second flow directions are at least partially different; and at least one frame device entirely accommodated in the housing, wherein the first and second flow devices are held spaced apart from one another in at least one region by the at least one frame device, wherein the second feed means is at least one inlet flange and the second discharge means is at least one outlet flange, and wherein the inlet flange, the outlet flange, or any combination thereof has a deep-drawn base body with a bushing which accommodates a predefined section of a pipe or which fits into the pipe.

2. A device for exchanging heat in an internal combustion engine in a motor vehicle, comprising:

an at least two-component, contoured housing with first and second housing components, wherein the first housing component has an essentially U-shaped outline cross section which is closed by the second housing component at an open side of the first housing component, wherein the second housing component is essentially planar, wherein edges of one of the first and second housing components that join with edges of the other of the first and second housing components extend into recesses formed in the edges of the other of the first and second housing components such that the edges of the first and second housing components that join together do not extend linearly relative to each other;

at least one first feed means for a first medium;

at least one first discharge means for the first medium;

at least one second feed means for a second medium on a first side of the housing;

at least one second discharge means for the second medium on a second side of the housing opposite the first side;

at least one first flow device for the first medium with a first flow path in a first flow direction, wherein the first flow device is accommodated in the housing;

at least one second flow device for the second medium with a second flow path in a second flow direction, wherein the second flow device is accommodated in the housing, wherein the first and second flow paths are separated from one another and the first and second flow directions are at least partially different; and at least one frame device entirely accommodated in the housing, wherein the first and second flow devices are held spaced apart from one another in at least one region by the at least one frame device, wherein the second feed means is at least one inlet flange and the second discharge means is at least one outlet flange, wherein the inlet flange, the outlet flange, or any combination thereof has a base body, wherein the base body is bent on at least two sides which cover at least two sides of the housing, has a bushing which accommodates a predefined section of a connecting pipe or which fits into the connecting pipe, and has at least one side which is recessed and into which at least one protruding component of the housing is inserted, wherein the at least one side of the base body which is recessed and into which the at least one protruding component of the housing is inserted is a first side, wherein the at least one protruding component of the housing is a first protruding component, and wherein the base body further comprises a second side which is recessed and into which a second protruding component of the housing is inserted.

3. The device for exchanging heat as claimed in claim 2, wherein the first feed means and the first discharge means are attached to one of the first and second housing components.

4. The device for exchanging heat as claimed in claim 2, wherein the first feed means and the first discharge means are arranged on a same side of the housing.

5. The device for exchanging heat as claimed in claim 2, wherein the first feed means and the first discharge means are arranged on opposite sides of the housing.

6. The device for exchanging heat as claimed in claim 2, wherein the at least one first feed means is a single or double feed means, and wherein the at least one first discharge means is a single or double discharge means.

7. The device for exchanging heat as claimed in claim 2, wherein the at least one second flow device comprises flat pipes.

8. The device for exchanging heat as claimed in claim 7, wherein the flat pipes are essentially arranged parallel to one another.

9. The device for exchanging heat as claimed in claim 7, wherein the flat pipes are arranged in one, two or more rows of parallel pipes, and wherein the rows of flat pipes are arranged parallel to one another, in series with one another, or any combination thereof.

10. The device for exchanging heat as claimed in claim 9, wherein each row of flat pipes comprises a predetermined number of pipes.

11. The device for exchanging heat as claimed in claim 2, wherein the first flow device has a region of turbulence devices.

12. The device for exchanging heat as claimed in claim 11, wherein the turbulence devices are selected from the group consisting of turbulence grills or plates, patterned surfaces, and turbulence generators.

13. The device for exchanging heat as claimed in claim 11, wherein a drop in pressure in the region of the turbulence devices in a main direction of flow is greater than a direction perpendicular to the main direction of flow.

14. The device for exchanging heat as claimed in claim 11, wherein the at least one second flow device comprises flat pipes, and wherein the first flow device has the first flow path determined essentially by a distance between the flat pipes, a distance from the housing, the turbulence devices, or any combination thereof.

15. The device for exchanging heat as claimed in claim 2, wherein the first flow device has dividing elements which define at least one predetermined flow path for the first medium.

16. The device for exchanging heat as claimed in claim 2, wherein components of the first and second flow devices, the housing, the first and second feed means, the first and second discharge means, or any combination thereof are manufactured from at least one material.

17. The device for exchanging heat as claimed in claim 16, wherein the at least one material is selected from the group consisting of aluminum, iron, brass, copper, titanium, aluminum alloy, iron alloys, PVC, PU, duroplastics, and fiber-reinforced plastics.

18. The device for exchanging heat as claimed in claim 2, wherein the first housing component forms essentially three contoured side faces of a cube, and wherein an orientation of the contouring assumes a predefined angle with respect to a main direction of flow of the second medium.

19. The device for exchanging heat as claimed in claim 2, wherein the first housing component forms essentially three contoured side faces of a cube, wherein the inlet flange and outlet flange have at least two components, and wherein the housing is closed off on two opposite end sides of the cube in a gas-tight fashion, a liquid-tight fashion, or any combination thereof.

20. The device for exchanging heat as claimed in claim 2, wherein the inlet flange, the outlet flange, or any combination thereof has a base body, wherein the base body is bent on at least two sides in a U-shape, has a bushing which accommodates a predefined section of a connecting pipe or which fits into the connecting pipe, and has at least one further bushing for accommodating a boundary element.

21. The device for exchanging heat as claimed in claim 20, wherein the second housing component, the boundary element, and the inlet and outlet flanges form a termination on end sides of the housing, wherein the termination is gas-tight, liquid-tight, or any combination thereof.

22. The device for exchanging heat as claimed in claim 2, wherein the first feed means and the first discharge means are bushings in the housing which accommodate a predefined section of a pipe or which fits inside the pipe.

23. The device for exchanging heat as claimed in claim 2, further comprising another frame device, wherein the at least one second flow device comprises flat pipes, and wherein the at least one frame device and the another frame device keep the flat pipes spaced apart.

24. The device for exchanging heat as claimed in claim 2, wherein the at least one second flow device comprises flat pipes, and the at least one frame device is an essentially planar plate which has a predefined number of bushings for accommodating the flat pipes.

25. The device for exchanging heat as claimed in claim 24, wherein the frame device and the flat pipes are connected in a gas-tight fashion, a liquid-tight fashion, or any combination thereof.

26. The device for exchanging heat as claimed in claim 2, wherein a materially joined connection, a frictionally locking connection, a positively locking connection, or any combination thereof is provided between components of the device for exchanging heat.

27. The device for exchanging heat as claimed in claim 2, wherein components of the device for exchanging heat are connected by a soldered connection.

28. The device for exchanging heat as claimed in claim 2, wherein the frame device is a plate with upturned edges which are connected to at least one section of an internal contour of the housing.

29. The device for exchanging heat as claimed in claim 28, wherein the turned up edges of the frame device have sharply edged or rounded corners.

30. The device for exchanging heat as claimed in claim 2, wherein the first medium is a refrigerating agent.

31. The device for exchanging heat as claimed in claim 2, wherein the second medium is combustion air.

32. The device for exchanging heat as claimed in claim 2, wherein the recesses formed in the edges of the other of the first and second housing components comprises notches or grooves and the edges of the one of the first and second housing components comprises projections which engage the notches or grooves.

33. The device for exchanging heat as claimed in claim 2, wherein the base body comprises a third side which covers a third side of the housing.

* * * * *